US008567107B1

(12) United States Patent
Bascue et al.

(10) Patent No.: US 8,567,107 B1
(45) Date of Patent: Oct. 29, 2013

(54) GUN CHAMBER CLEANING BRUSH WITH CONTAINER

(75) Inventors: Clyde H. Bascue, Niskayuna, NY (US); Paul Watson, Niskayuna, NY (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 392 days.

(21) Appl. No.: 12/271,074

(22) Filed: Nov. 14, 2008

(51) Int. Cl.
*F41A 29/02* (2006.01)
*B08B 9/043* (2006.01)

(52) U.S. Cl.
USPC ..... 42/95; 15/104.16

(58) Field of Classification Search
USPC ..... 42/95; 15/104.05, 104.16, 164; D4/128; D32/42
See application file for complete search history.

(56) References Cited

U.S. PATENT DOCUMENTS 95,468 A * 10/1869 Greenfield ..... 15/104.2
190,123 A * 5/1877 Budd ..... 15/104.16
251,323 A * 12/1881 Vonderlinden ..... 15/164
1,258,737 A * 3/1918 Bemis ..... 15/104.2
2,495,793 A * 1/1950 Webb ..... 15/104.18
2,805,434 A * 9/1957 Hopkins ..... 15/104.16
2,824,322 A * 2/1958 Angelica et al. ..... 15/104.09
3,536,160 A * 10/1970 Brewer ..... 184/109
3,602,935 A * 9/1971 McDonnell et al. ..... 15/104.09
4,726,137 A * 2/1988 Zurek et al. ..... 42/95
4,866,871 A * 9/1989 Rivers ..... 42/95
5,588,242 A * 12/1996 Hughes ..... 42/95
5,871,589 A * 2/1999 Hedge ..... 134/8
7,370,383 B1 * 5/2008 Chinowsky ..... 15/164
7,676,878 B2 * 3/2010 Parker-Smith ..... 15/104.05
2002/0000016 A1 * 1/2002 Hsieh ..... 15/164

* cited by examiner

*Primary Examiner* — Bret Hayes
(74) *Attorney, Agent, or Firm* — Henry S. Goldfine

(57) ABSTRACT

A chamber cleaning brush for a gun chamber may include a generally cylindrical body; at least three groups of bristles spaced axially apart along the body; and a pivot ring disposed on the body between two of the groups of bristles. The body may include a larger diameter portion and a smaller diameter portion with at least one group of bristles disposed on the larger diameter portion and at least two groups of bristles disposed on the smaller diameter portion.

18 Claims, 6 Drawing Sheets

GUN CHAMBER CLEANING BRUSH WITH CONTAINER

STATEMENT OF GOVERNMENT INTEREST

The inventions described herein may be manufactured, used and licensed by or for the U.S. Government for U.S. Government purposes.

BACKGROUND OF THE INVENTION

The invention relates, in general, to munitions, and, in particular, to cleaning brushes for gun chambers.

Projectiles or rounds launched from gun tubes may foul the gun tube's chamber. Some gun tubes, such as the 105 mm gun (M68A1E4) used on combat vehicles, may have tapered firing chambers and forcing cone areas. Soldiers have experienced problems with cleaning the tapered firing chamber and forcing cone of some gun tubes. The forcing cone area of the gun tube has been susceptible to carbon build-up from fired rounds. The contamination and build-up has been significant enough to cause difficulties in chambering/loading a round, and pitting/corrosion has been present in unclean chambers.

A tool to effectively clean this area of the gun has not been available. In the past, this area of the gun tube was cleaned using wire hand brushes, a screwdriver, and a rag. Or, the gun tube was soaked for a few days with a solvent to first reduce the carbon contamination build-up, and then the area was cleaned using the hand tools. A need exists for a tool to better clean the firing chamber and forcing cone area of gun tubes.

SUMMARY OF THE INVENTION

It is an object of the invention to provide a cleaning brush for a gun chamber.

One aspect of the invention is a brush for cleaning a gun chamber, comprising a generally cylindrical body; at least three groups of bristles spaced axially apart along the body; and a pivot ring disposed on the body between two of the groups of bristles.

The body may include a larger diameter portion and a smaller diameter portion. At least one group of bristles may be disposed on the larger diameter portion and at least two groups of bristles may be disposed on the smaller diameter portion. The body may include a circumferential groove formed adjacent the pivot ring. The brush may further comprise a snap ring disposed in the circumferential groove.

Each of the at least three groups of bristles may include subgroups of bristles spaced circumferentially around the body. The subgroups of bristles may be equally spaced circumferentially around the body. The subgroups of bristles may comprise individual tufts. The tufts may be arranged generally helically around the body.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

The inventive chamber brush may be tapered, with many angular surfaces to follow the contours and tapers within the gun tube's chamber. The chamber brush may readily clean the gun tube's chamber with minimal effort, compared to the old manual methods of cleaning the chamber. In addition to keeping the chamber clean and allowing a round to be inserted more readily, another advantage of a clean chamber is that it may significantly reduce pits that occur due to contamination. These pits reduce the life of the gun tube because they induce stress concentrations that can lead to cracking and failure.

The chamber brush may be mounted on a threaded staff or rod. The user may insert the brush into the chamber and push the brush toward the end of the firing chamber (i.e. the forcing cone) by hand, while also rotating the brush. When the forcing cone is reached, the brush cannot move further axially because it is stopped on the pivot ring. At this point, the brush may be rotated by hand to remove residue. This procedure may be repeated several times until the firing chamber is visually clean. Rotating the brush while moving the brush forward cleans the walls of the chamber. The forcing cone or tapered area may be cleaned by rotating the brush, while keeping the brush axially stationary. Axial and circumferential gaps between the individual brush tufts allow corrosion material to be collected and removed when the brush exits the chamber.

Figure 1:
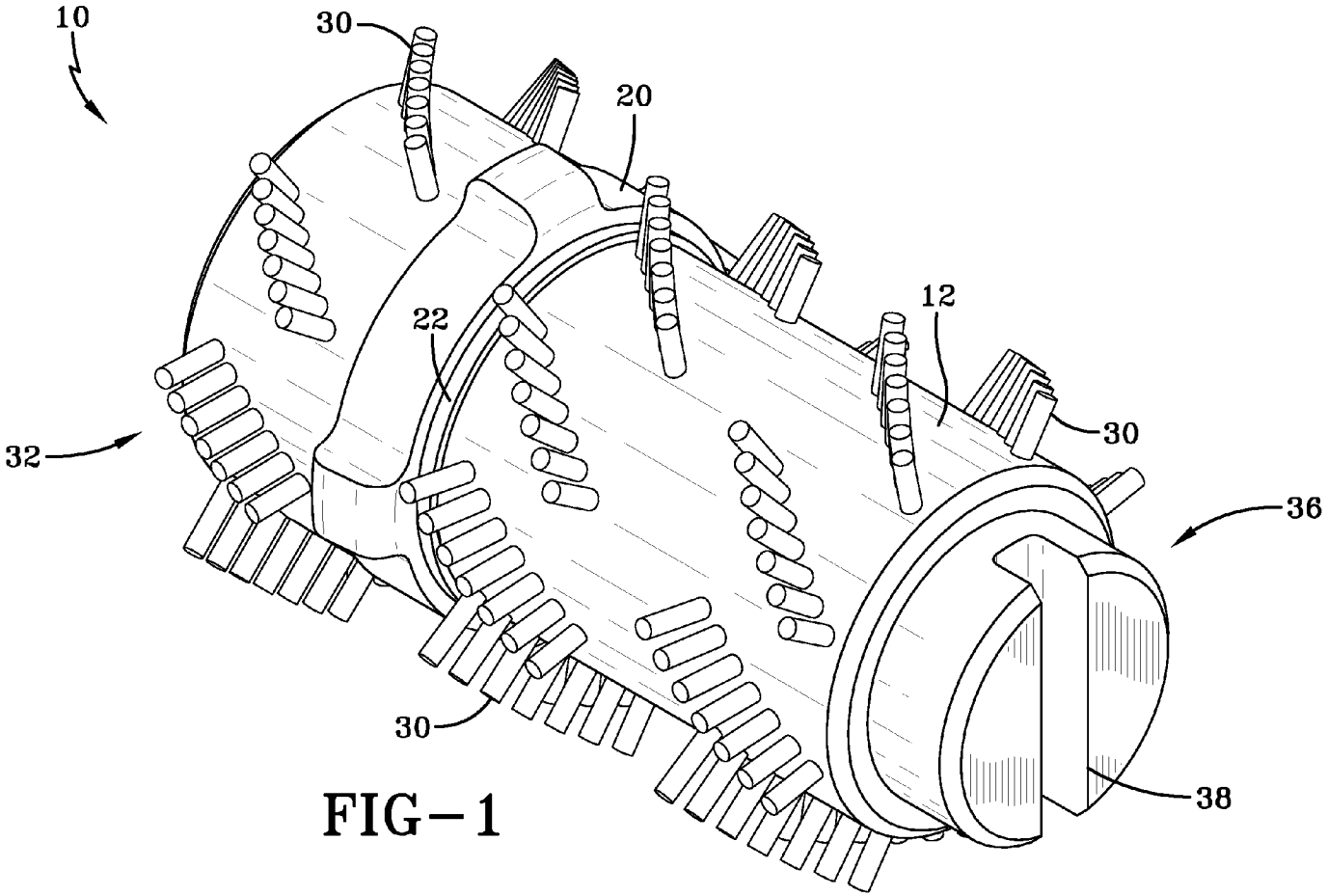
FIG. 1 is a perspective view of an embodiment of a chamber brush.
Figure 2:
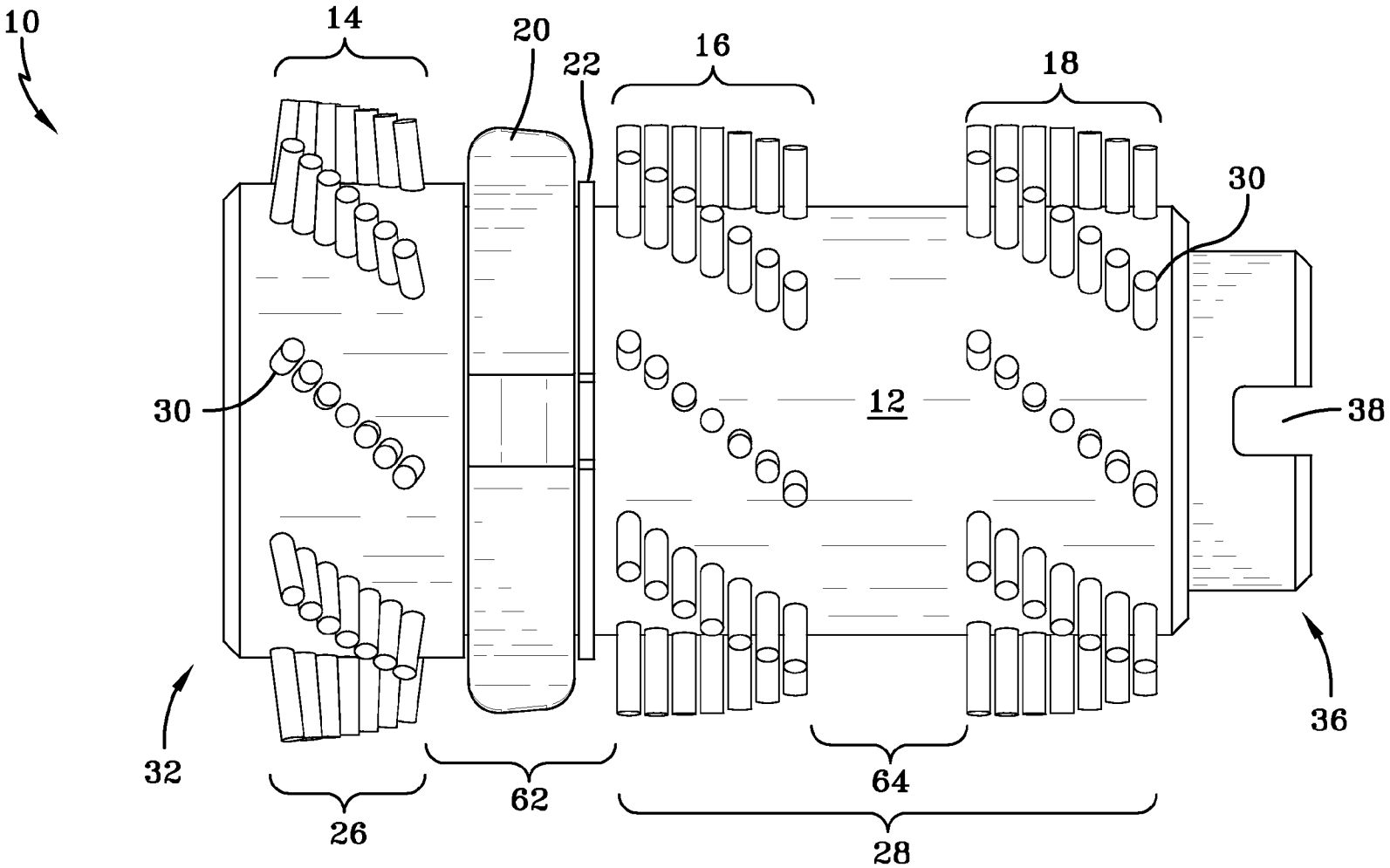
FIG. 2 is a side view of the brush of FIG. 1.

FIG. 1 is a perspective view of an embodiment of a chamber brush 10. FIG. 2 is a side view of the brush 10 of FIG. 1. Brush 10 may include a generally cylindrical body 12 and at least three groups of bristles 14, 16, 18 spaced axially apart along the body 12. The axial spaces 62, 64 between the at least three bristle groups 14, 16, 18 provide space for containing material (that is, fouling or contaminants, for example) from inside the gun chamber, until the brush 10 is removed from the gun tube.

A pivot ring 20 may be disposed on the body 12 between two of the groups of bristles, for example, between groups 14 and 16. Body 12 may include a circumferential groove 24 (FIG. 3) formed adjacent the pivot ring 20. A snap ring 22 (FIG. 2) may be disposed in groove 24. Snap ring 22 may help to maintain the position of pivot ring 20.

Body 12 may be formed of, for example, polyvinylchloride. Body 12 may include a larger diameter portion 26 and a smaller diameter portion 28 At least one group of bristles 14 may be disposed on the larger diameter portion 26 and at least two groups of bristles 16, 18 may be disposed on the smaller diameter portion 28.

Each of the at least three groups of bristles 14, 16, 18 may include subgroups (FIG. 3) of bristles spaced circumferentially around the body 12. For example, bristle group 14 may include subgroups 141, 142, 143, 144, 145, and so. Bristle group 16 may include subgroups 161, 162, 163, 164, 165, and so on. Bristle group 18 may include subgroups 181, 182, 183, 184, 185, and so on. The subgroups of bristles may be spaced equally circumferentially around the body 12. Similar to the axial spaces between the bristle groups, the circumferential spaces between the subgroups of each bristle group provide space for containing material (that is, fouling or contaminants, for example) from inside the gun chamber, until the brush 10 is removed from the gun chamber.

The number of subgroups of bristles in each bristle group may vary. In one embodiment, bristle groups 14 and 16 may include eight subgroups and bristle group 18 may include nine subgroups. Each subgroup may include a plurality of tufts 30. The number of tufts 30 per bristle subgroup may vary. In the embodiment shown in the Figs., the number of tufts 30 for each subgroup may be seven. The tufts 30 of each subgroup may be arranged in a variety of ways. In one embodiment, the tufts 30 of each subgroup may be arranged generally helically on the body 12.

The "pitch" of a subgroup of tufts 30 is akin to the pitch of a screw thread or the pitch of a propeller. For example, the tufts 30 of each of the subgroups of the bristle groups 14, 16, 18 may have a pitch in the range of about 5 inches to about 15 inches. The tufts 30 of the subgroups 141, 142, 143, and so on, of bristle group 14 may have, for example, a pitch in the range of about 11 inches to about 16 inches, and, preferably, the pitch may be about 13.5 inches. The tufts 30 of the subgroups 161, 162, 163, and so on, of bristle group 16 may have, for example, a pitch in the range of about 10 to about to about 15 inches, and, preferably, the pitch may be about 12.5 inches. The tufts 30 of the subgroups 181, 182, 183, and so on, of bristle group 18 may have a pitch in the range of about 8 inches to about 13 inches, and, preferably, the pitch may be about 10.9 inches.

The arrangement of the tufts 30, subgroups of bristles, and groups of bristles may be such that, at a transverse cross-section of a gun tube, substantially the entire internal circumference of the tube is contacted by the tufts 30 when the brush 10 is inserted in the tube, even without rotating the brush 10 in the tube.

Figure 9:
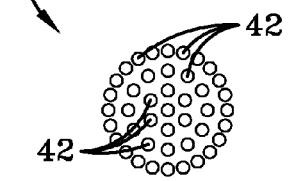
FIG. 9 is a top view of an exemplary tuft.

The diameter of each tuft 30 may vary. In one embodiment, the diameter of a tuft 30 may be about 0.19 inches. Each tuft 30 may comprise a plurality of strands 42 (FIG. 9). An exemplary composition of strands 42 in a tuft 30 may be about 70% of 0.006 inch diameter phosphor bronze strands and about 30% of 0.008 inch diameter nylon strands.

Figure 3:
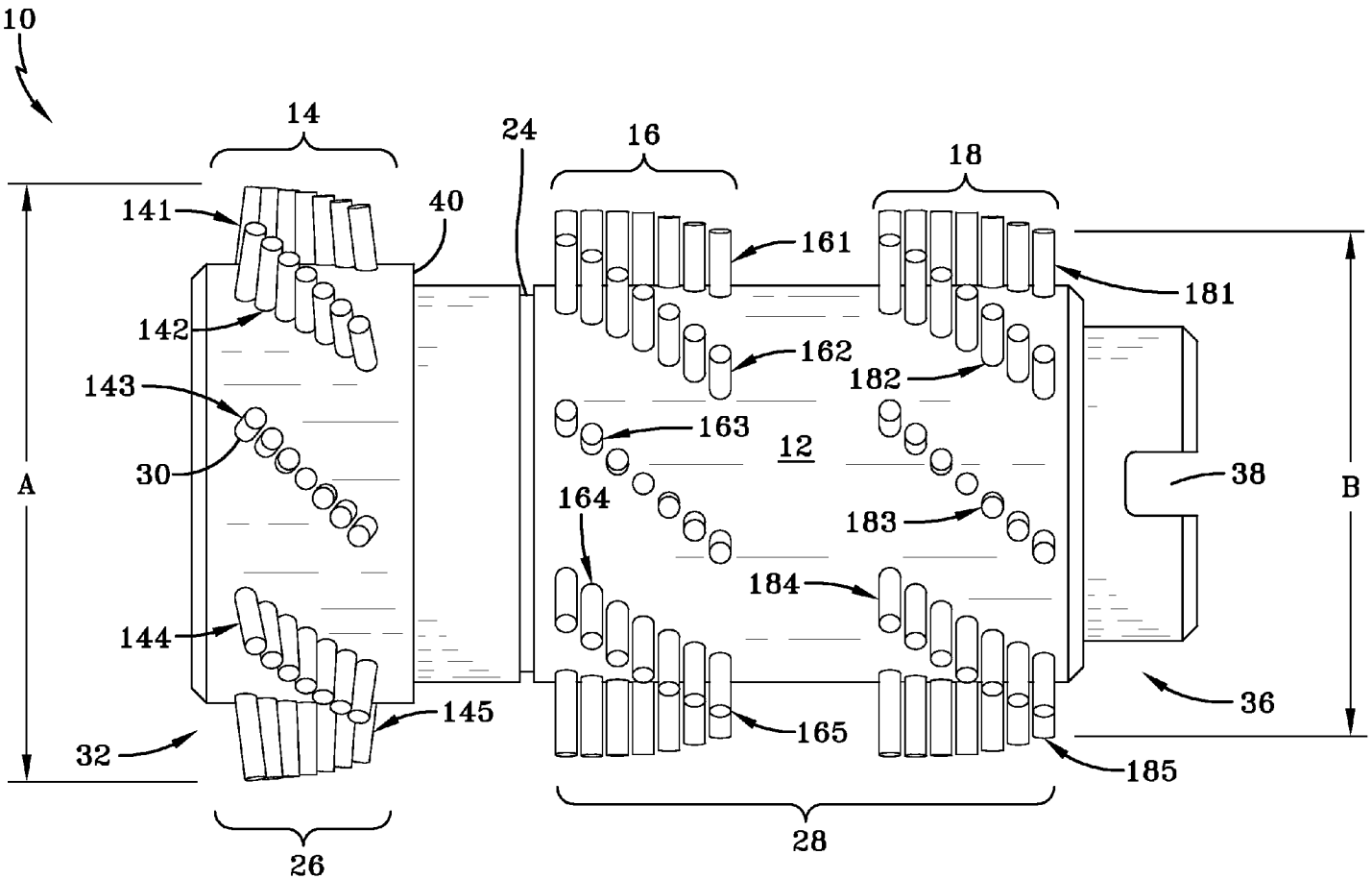
FIG. 3 is a side view of the brush of FIG. 1, without the pivot ring.

As seen in FIG. 3, the outside diameter of the brush 10, measured from the tip of one tuft 30 to the tip of a diametrically opposite tuft 30, may decrease from end 32 to end 38. The largest diameter is indicated as A at end 32, and the smallest diameter is indicated as B at end 38. In one embodiment, the brush outside diameter in bristle group 14 may decrease from about 5.34 inches to about 5.01 inches; the brush outside diameter in bristle group 16 may decrease from about 4.90 inches to about 4.55 inches; and the brush outside diameter in bristle group 18 may decrease from about 4.66 inches to about 4.37 inches.

Figure 5:
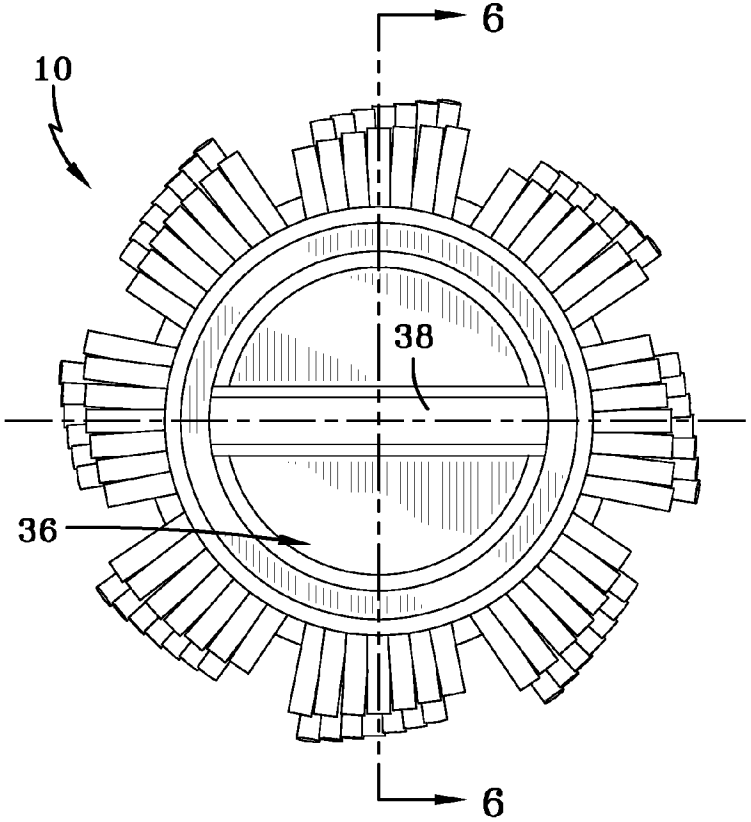
FIG. 5 is an end view of FIG. 3 (small diameter end).
Figure 4:
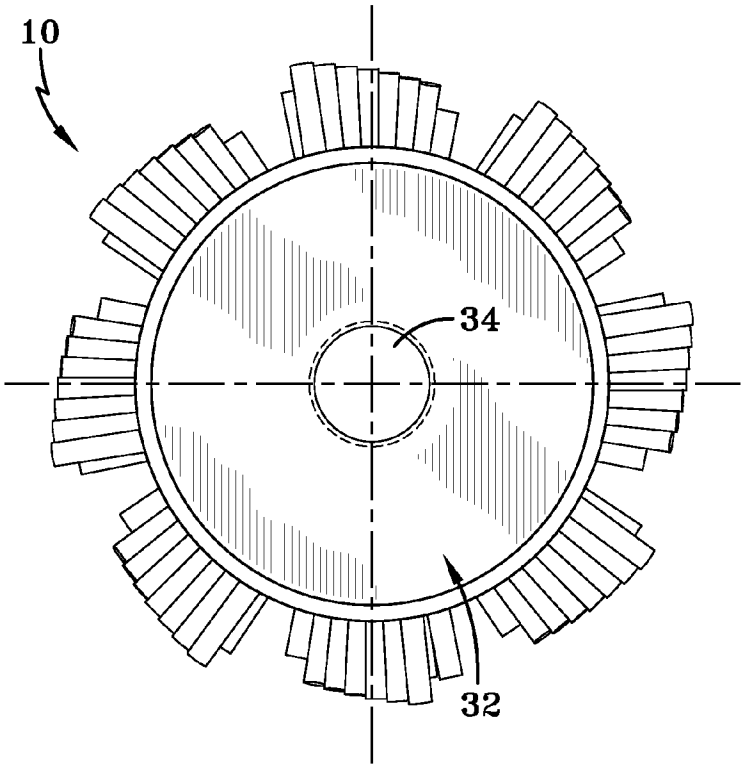
FIG. 4 is an end view of FIG. 3 (large diameter end).
Figure 6:
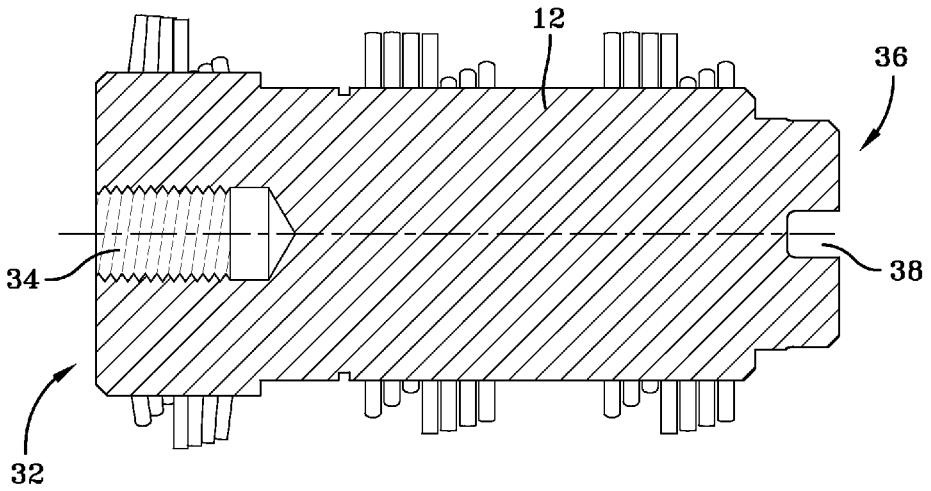
FIG. 6 is a sectional view taken along the line 6-6 of FIG. 5.

One end 32 (FIGS. 4 and 6) of the body 12 may include a threaded opening 34. A rod (not shown) may be threaded into opening 34 and may be used to insert the brush 10 in a gun tube. An opposite end 36 (FIGS. 5 and 6) of the body 12 may include a slot 38. The slot 38 may be used when threading the brush 10 onto or off of the rod. Particularly when the brush 10 is soiled, one may use, for example, a screwdriver or metal plate inserted into slot 38 to unthread the brush 10 from the rod.

Figure 7:
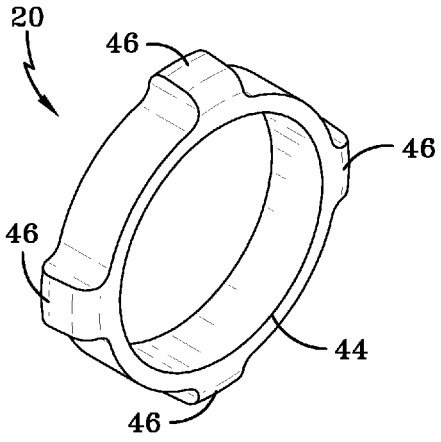
FIG. 7 is a perspective view of an embodiment of a pivot ring.
Figure 8:
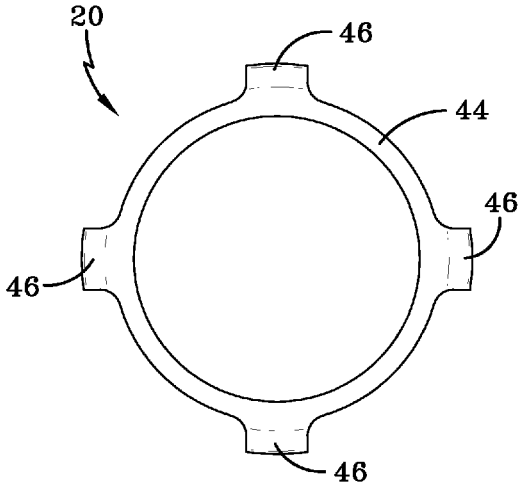
FIG. 8 is an end view of the pivot ring of FIG. 7.

FIGS. 7 and 8 show the pivot ring 20. Pivot ring 20 may be made of, for example, Ultra High Molecular Weight Polyethylene (UHMW-PE). The UHMW-PE has non-sticking, self-lubricating properties that allow rotation of the brush 10 when fully inserted into the chamber. The axial position of pivot ring 20 on body 12 may be maintained by the snap ring 22 (FIG. 2) on one side and the edge 40 of the larger diameter portion 26 on the other side.

As shown in FIGS. 7 and 8, the pivot ring 20 may include a generally annular member 44 and at least one projection 46 extending beyond the outside diameter of the annular member 44. In one embodiment, the number of projections 46 may be four. The projections 46 may be circumferentially spaced equally around the annular member 44. Pivot ring 20 may provide a "stop" for the brush 10 so that the brush 10 may rotate in the gun chamber without being jammed or pushed too far into the narrow end of the chamber. In the embodiment shown, the projections 46 prevent the brush 10 from being jammed or pushed too far into the narrow end of the chamber.

Figure 10:
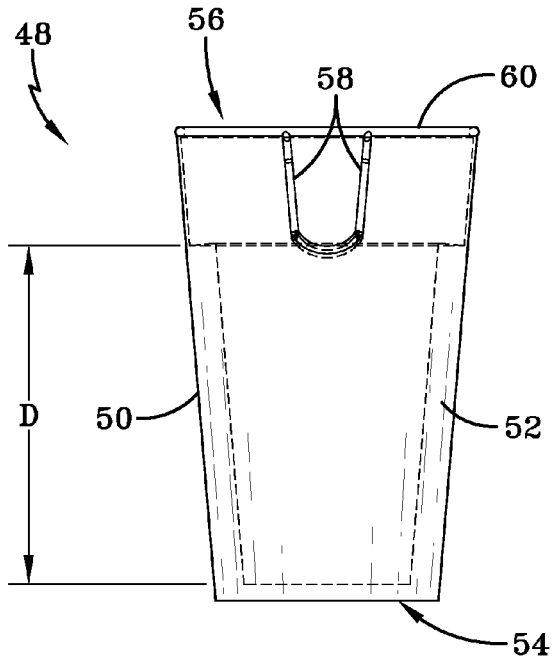
FIG. 10 is a side view of an embodiment of a container for a brush.
Figure 11:
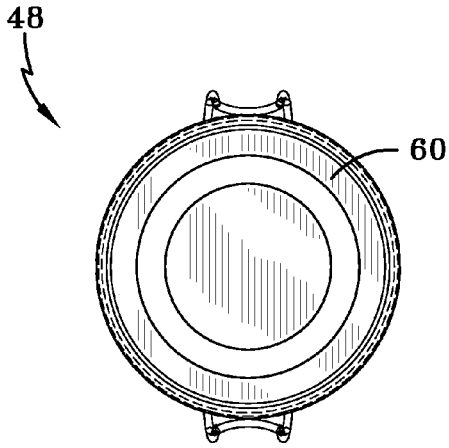
FIG. 11 is a top view of the container of FIG. 10.

The brush 10 may include a storage container, for example, the storage container 48 shown in FIGS. 10 and 11. Container 48 may have a frusto-conical shape, for example, with a closed bottom end 54 and an open top end 56. Top end 56 includes opening 60 for inserting the brush 10 therein. The materials for container or storage bag 48 may be selected based on their ability to resist any residual solvents that may exist on the brush 10, and thereby deteriorate or breakdown the container material.

The container or storage bag 48 may comprise an outer layer 50. Outer layer 50 may comprise, for example, a polyvinylchloride (PVC) coated fabric, such as PVC coated nylon or polyester, for example. The fabric may be, for example, a nine ounce fabric.

Container 48 may include an inner layer 52. Inner layer 52 may partially cover the interior side surfaces of container 48. For example, in FIGS. 10 and 11, inner layer 52 may extend from about the bottom 54 of the container 48 a distance D towards the top 56 of the container. The distance D may be, for example, about three-fourths of the distance from the bottom 54 to the top 56 of the container. Inner layer 52 may comprise a layer of high density polyethylene (HDPE) having a thickness of, for example, about 0.03 inches, covered by a layer of closed-cell foam cushioning having a thickness of, for example, about 0.38 inches. A suitable closed-cell foam may be sold under the name VOLARA. The foam layer may be the interior layer of inner layer 52, that is, the foam layer may contact the brush 10.

The bottom 54 of container 48 may comprise a double layer of the PVC coated fabric used for outer layer 50, and an interior layer of the closed-cell foam used in inner layer 52. A drawstring 58 may be used to close opening 60. Drawstring 58 may comprise, for example, braided nylon rope about 0.125 inches in diameter.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A brush for cleaning a gun chamber, comprising:

a generally cylindrical body having one end and an opposite end;

at least three groups of bristles spaced axially apart along the body; and a pivot ring disposed on the body between two of the groups of bristles, the pivot ring including a generally annular member and a plurality of projections extending beyond an outside diameter of the annular member, the plurality of projections being circumferentially spaced substantially equally around the annular member, the pivot ring being rotatable on the body.

2. The brush of claim 1, wherein the body includes a larger diameter portion and a smaller diameter portion, with at least one group of bristles disposed on the larger diameter portion and at least two groups of bristles disposed on the smaller diameter portion.

3. The brush of claim 1, wherein the body includes a larger diameter portion and a smaller diameter portion, the pivot ring being disposed between the larger diameter portion and the smaller diameter portion and axially maintained in position by an edge of the larger diameter portion and a snap ring disposed in a circumferential groove formed adjacent the pivot ring.

4. The brush of claim 3, wherein outside diameters of respective ones of the at least three groups of bristles decrease from the one end to the opposite end.

5. The brush of claim 1, wherein each of the at least three groups of bristles include subgroups of bristles spaced circumferentially around the body.

6. The brush of claim 5, wherein the subgroups of bristles are equally spaced circumferentially around the body.

7. The brush of claim 6, wherein two groups of bristles comprise eight subgroups and one group of bristles comprises nine subgroups.

8. The brush of claim 6, wherein the subgroups of bristles comprise individual tufts.

9. The brush of claim 8, wherein the tufts are arranged generally helically around the body.

10. The brush of claim 8, wherein each tuft comprises a plurality of strands, the strands comprising about 70% phosphor bronze strands and about 30% nylon strands.

11. The brush of claim 8, wherein outside diameters of the brush, measured from a tip of one tuft to a tip of another tuft, decrease from a first end of the brush to a second end of the brush.

12. The brush of claim 1, wherein one end of the body includes a threaded opening and another end of the body includes a slot formed therein.

13. The brush of claim 1, further comprising a container for the brush.

14. The brush of claim 13, wherein the container comprises an outer layer made of PVC coated fabric.

15. The brush of claim 14, wherein the container comprises an inner layer having a layer of HDPE covered by a layer of closed-cell foam.

16. A brush for cleaning a gun chamber, comprising:

a generally cylindrical body having one end, an opposite end, a larger diameter portion and a smaller diameter portion;

at least three groups of bristles spaced axially apart along the body;

a pivot ring disposed on the body between the larger diameter portion and the smaller diameter portion, the pivot ring including a generally annular member and a plurality of projections extending beyond an outside diameter of the annular member, the plurality of projections being circumferentially spaced substantially equally around the annular member, the pivot ring being rotatable on the body; and a snap ring disposed in a circumferential groove formed adjacent the pivot ring, the pivot ring being axially maintained in position by an edge of the larger diameter portion and the snap ring.

17. The brush of claim 16, wherein outside diameters of respective ones of the at least three groups of bristles decrease from the one end to the opposite end.

18. A brush for cleaning a gun chamber, comprising:

a generally cylindrical body having one end, an opposite end, a larger diameter portion and a smaller diameter portion;

at least three groups of bristles spaced axially apart along the body;

a pivot ring disposed on the body between the larger diameter portion and the smaller diameter portion, the pivot ring including a generally annular member and a plurality of projections extending beyond an outside diameter of the annular member, the plurality of projections being circumferentially spaced substantially equally around the annular member, the pivot ring being rotatable on the body; and a snap ring disposed in a circumferential groove formed adjacent the pivot ring, the pivot ring being axially maintained in position by an edge of the larger diameter portion and the snap ring, wherein outside diameters of respective ones of the at least three groups of bristles decrease from the one end to the opposite end.

* * * * *